US006733199B2

(12) United States Patent
Dingert et al.

(10) Patent No.: US 6,733,199 B2
(45) Date of Patent: May 11, 2004

(54) DEVICE FOR WIPING AND CLEANING DIRTY SURFACES

(75) Inventors: Uwe Dingert, Abtsteinach (DE); Hans-Jürgen Wendelken, Sinsheim (DE)

(73) Assignee: Carl Freudenberg KG, Weinheim (DE)

( * ) Notice: Subject to any disclaimer, the term of this patent is extended or adjusted under 35 U.S.C. 154(b) by 0 days.

(21) Appl. No.: 10/150,424

(22) Filed: May 16, 2002

(65) Prior Publication Data

US 2002/0176735 A1 Nov. 28, 2002

(30) Foreign Application Priority Data

May 18, 2001 (DE) ..... 101 24 336

(51) Int. Cl.[7] ..... A47L 13/32
(52) U.S. Cl. ..... 401/1
(58) Field of Search ..... 401/1, 2, 263, 401/261, 270, 268

(56) References Cited

U.S. PATENT DOCUMENTS

| | | | | | |
|---|---|---|---|---|---|
| 947,145 | A | * | 1/1910 | Ax | 401/207 |
| 1,375,560 | A | | 4/1921 | Campbell | |
| 1,752,581 | A | * | 4/1930 | Steirert et al. | 401/263 |
| 1,831,463 | A | * | 11/1931 | Nobbs | 401/1 |
| 1,969,036 | A | * | 8/1934 | Riebel, Jr. | 401/2 |
| 4,312,598 | A | * | 1/1982 | Vagner | 401/1 |
| 5,397,194 | A | * | 3/1995 | Yuan et al. | 401/186 |
| 5,720,555 | A | * | 2/1998 | Elele | 374/150 |
| 6,202,249 | B1 | * | 3/2001 | Jenkins et al. | 15/228 |
| 6,273,625 | B1 | * | 8/2001 | Martinez de San Vincente Oliveras | 401/1 |

FOREIGN PATENT DOCUMENTS

| | | |
|---|---|---|
| DE | 1 809 184 | 7/1969 |
| DE | 30 05 558 | 8/1980 |
| DE | 296 08 844 | 9/1996 |
| DE | 195 16 854 | 11/1996 |
| DE | 297 04 742 | 11/1997 |
| GB | 228890 | 7/1925 |
| GB | 2 225 930 | 6/1990 |

* cited by examiner

*Primary Examiner*—Gregory L. Huson
*Assistant Examiner*—Huyen Le
(74) *Attorney, Agent, or Firm*—Kenyon & Kenyon

(57) ABSTRACT

A device for wiping and cleaning dirty surfaces, with a carrier body (1) for a wiping element (3), where the carrier body (1) is structured as a latent heat storage unit.

25 Claims, 5 Drawing Sheets

DEVICE FOR WIPING AND CLEANING DIRTY SURFACES

BACKGROUND OF THE INVENTION

1. Field of the Invention

The invention relates to a device for wiping and cleaning dirty surfaces, having a carrier body for a wiping element.

2. Description of Related Art

A cleaning device is known from German Patent 30 05 558, in which a holder for a fluid container and a heating plate for heating a wiping pad are arranged at the bottom end of a handle. The fluid container is mounted on the handle, in mobile manner, in such a way that a valve opens by pressing on the container, and the wiping pad located underneath is moistened. In this connection, an excessive discharge of cleaning fluid can occur, and as a result, wood surfaces that are sensitive to moisture, for example, can be impaired in terms of their usage value and appearance. The cleaning device is furthermore structured in extremely complicated manner, and requires a power connection for the power supply to the built-in heating resistors of the heating plate.

SUMMARY OF THE INVENTION

It is an object of the invention to simplify a device for wiping and cleaning dirty surfaces of the type having a carrier body for a wiping element and to improve it in such a way that it is more easily possible to remove dirt particles that are adhering to a surface to be cleaned, without any damage to the surface caused by excessive moisture.

These and other objects of the invention are achieved by a device for wiping and cleaning dirty surfaces, having a carrier body (1) for a wiping element (3), wherein the carrier body (1) is designed as a latent heat storage unit.

BRIEF DESCRIPTION OF THE DRAWINGS

The invention will be described in greater detail with reference to the following drawings wherein.

DETAILED DESCRIPTION OF THE INVENTION

Figure 1:
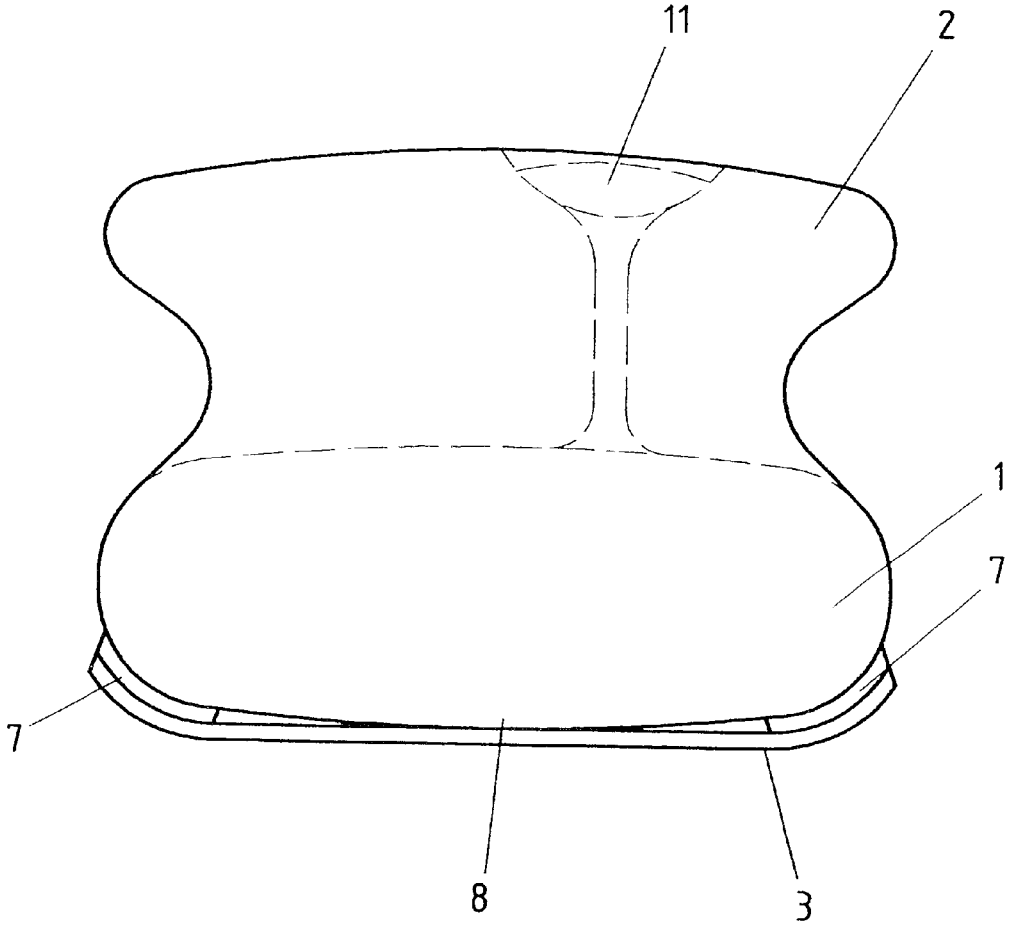
FIG. 1 shows a side view of a first embodiment of the invention.

In the device according to the invention, it is provided that the carrier body for the wiping element is structured as a latent heat storage unit. In this connection, the invention proceeds from the knowledge that supplying heat makes it easier to release dirt particles. This heat supply is provided by way of the wiping element, which, since it is heated by the heat storage unit, has a higher temperature than the temperature at the dirty surface. Therefore, wax streaks, for example, can be removed from furniture surfaces or glass in very gentle manner and without high pressing forces. Since the energy source is hidden in the cleaning body and is moved along with it, no power connection is necessary. The heat supply to the dirty surface can be metered by using adapted dwell times during the wiping movement. Hot water, which is generally carried along in a bucket for removal of firmly adhering dirt particles, is eliminated by the latent heat storage unit. The cleaning device is therefore particularly well suited for cleaning surfaces that are sensitive to moisture, where this use can lie both in the household sector and in the commercial sector. The device according to the present invention can be implemented in different dimensions, and can be used for cleaning different surfaces, such as window surfaces, furniture, or floor surfaces.

The heat storage unit can have a sensor for a temperature display. If the temperature drops below the necessary temperature limit, the user is thereby informed that renewed heating of the heat storage unit must be carried out, and, if necessary, hot water must be filled in again. The sensor can be made of a plastic that contains a thermochrome material. This changes its color if the temperature drops below a minimum temperature, and this makes it particularly easy to see that heating is required. The plastic that forms the sensor, with the content of a thermochrome material, can, at the same time, if necessary, form the sheath that encloses the heat storage unit, at least proportionally. In this connection, it is also possible to structure the sheath as a tank for the cleaning fluid, for example heated water, at the same time.

The device can therefore be constructed in very simple manner. Heated water is always available in households. It is preferred if the wiping element covers a segment of the tank wall that forms a heat conduction zone. Because the tank wall is structured as a heat insulator and only a segment is heat-conductive, the energy source of the heat storage unit is used efficiently.

A carrier body made of polymer material is preferred. The device can thereby be produced in very cost-effective manner, as an injection-molded part. It is practical if the wall has a zone with reduced thickness in the region of the heat conductivity zone. If necessary, it can be reinforced by stiffening ribs, in order to ensure that uniform pressing forces are exerted on the surface to be cleaned.

It is practical if the carrier body is essentially structured as a flat rectangular block. In this way, it is most easily possible to transfer the heat contained in it to the wiping element, at a relatively low weight. To facilitate handling, a hand hold can be provided at its top, for example a handle or a stick. It has proven to be practical, particularly if the device is structured as a floor cleaning device, if the hand hold is connected approximately with the middle of the top of the carrier body by way of a cardan joint. This embodiment permits easy cleaning even in tight places and in corners.

It has proven to be practical if the wiping element is a removable wiping cloth made of a nonwoven fabric, a loom-knitted or knitted textile. It is practical if a disposable wiping cloth is used in this connection. It can be attached to the carrier body by way of Velcro fasteners or insertion pockets.

If a cleaning fluid is used as the heating storage unit, it has proven to be advantageous if the tank has at least one opening through which the cleaning fluid can exit, in order to moisten the wiping element. It has proven to be practical, in such an embodiment, if the opening can be closed, if necessary. The amount of cleaning fluid used can thereby be metered as required, and an improved cleaning effect can be achieved.

Further simplification in handling is achieved if means are provided to meter the amount of cleaning fluid that exits from the opening.

In terms of design, the device can be structured in particularly simple manner if the opening mentioned above is arranged at the bottom of the tank. In this connection, it has proven to be a further improvement if a water distributor is arranged between the opening and the wiping element. This improves uniform wetting of the wiping element.

The mechanism for metering the cleaning fluid can be formed by a pump. The displacement element contained in it can be formed by a piston or, as an alternative, by an elastically deformable component of the wall of the tank. In the case of a design where the tank is made of plastic, it can be produced in particularly simple manner by using the blow-molding technique.

In order to ensure uniform pressure of the wiping element against the surface to be cleaned, for example against a floor covering with a certain unevenness in the surface, it has proven to be advantageous if the water distributor is made of an elastic plate, for example a plate of closed-cell foam material. This can be provided with distribution channels, in order to ensure uniform wetting of the wiping element in all of its areas.

Different materials can be used for the wiping element. Knitted or loom-knitted textiles have proven themselves in this connection. The wiping element can be a multi-use, removable wiping cloth, or a disposable wiping cloth. It is advantageous if the wiping cloth is attached to the carrier body by way of a Velcro fastener or by way of insertion pockets, so that it can be easily removed from the carrier body and cleaned.

FIG. 1 shows an embodiment of the invention, as an example, as it is particularly proven in household use. A carrier body 1, which is structured as a tank, is molded onto a hand hold 2, which is structured as a gripper. The tank can be filled with heated water through a filling opening 11. A segment 8 of the wall of the tank is structured as a heat conduction zone 8. Wiping element 3 is attached to carrier body 1 by a Velcro fastener 7. The cleaning process is supported by a supply of heat that reaches wiping element 3, and thereby the surface to be cleaned, from heat storage unit 1 via heat conduction zone 8. The cleaning body shown in FIG. 1 can be produced at low cost, using injection-molding technology, and is thereby characterized, particularly in the household sector, by its universal usability. Depending on the area of application, wiping element 3 can be structured in different ways, for example as a dry wipe cloth made of a microfiber textile, or as a moistened sponge cloth.

Figure 2:
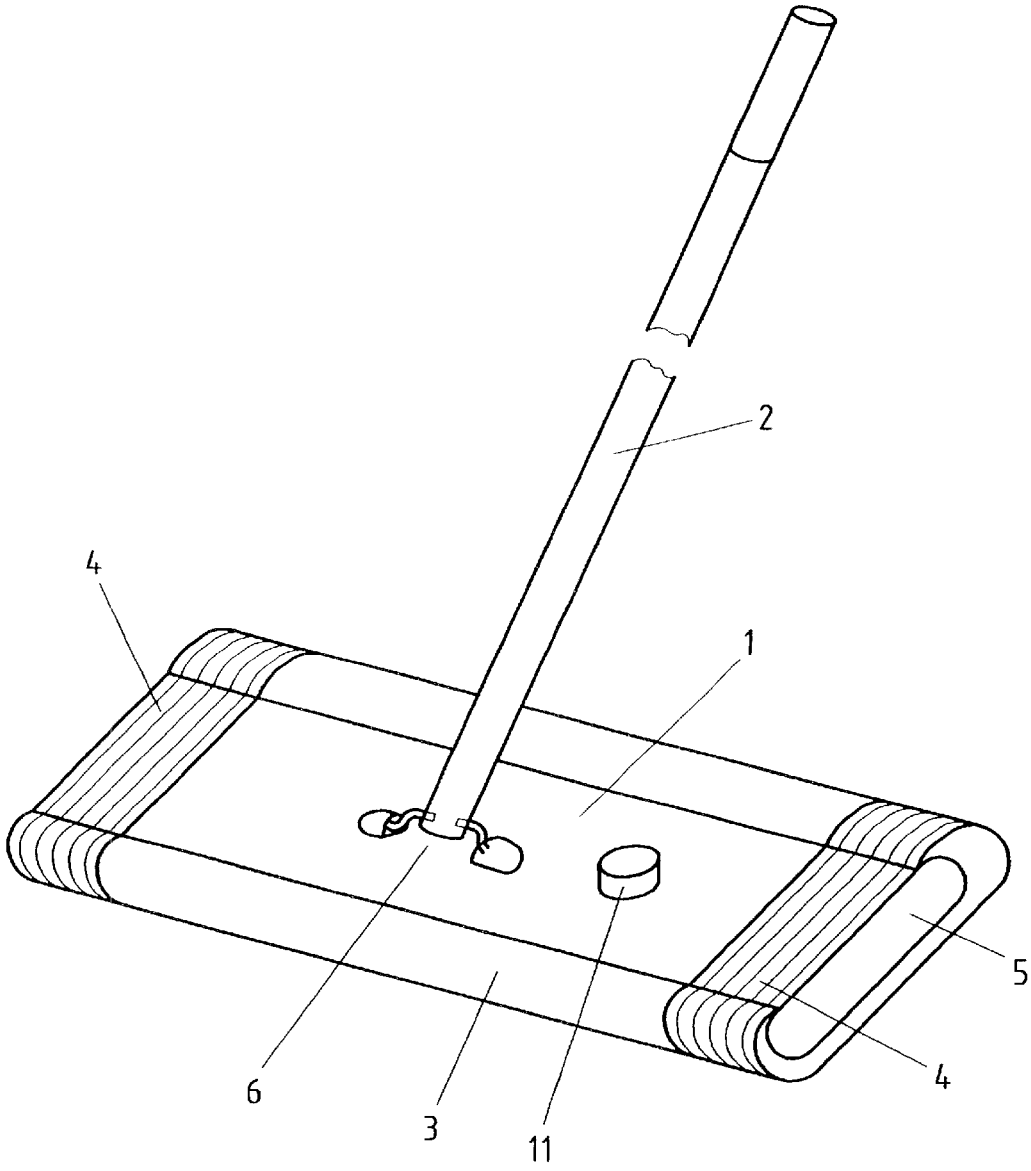
FIG. 2 shows a second embodiment of the invention, in a three-dimensional representation.

A preferred embodiment as a flat wiping device for wiping and cleaning floors is shown in FIG. 2. Carrier body 1 is structured as a flat rectangular block and serves as a latent heat storage unit that can be filled with heated water via a filling opening 11. At the top of the block-shaped carrier body, a handle 2 is mounted using the cardan technique, via a joint 6. A wiping cloth 3 encloses a bottom side and broad sides of the block, and is attached to carrier body 1 by insertion pockets 4. The center of gravity of the wiping device lies very low, and the cardan joint facilitates handling, even under furniture and in tight spaces. Because wiping cover 3 projects beyond base surfaces 5 of the block, damage to furniture during the wiping process is prevented. Carrier body 1 can be produced, for example, as a blow-molded part made of polymer material, which makes production of the cleaning device particularly cost-effective. Wiping element 3 can have different forms and be adapted to the floor surface to be cleaned. The cleaning device is suitable both for dry cleaning and for wet cleaning, where the wiping cover can be structured in different ways. For example, wiping cover 3 can be a nonwoven fabric, a sponge made of polyurethane or viscose. Premoistened sponge cloths or a woven textile or a knitted or loom-knitted textile are also suitable.

Figure 3:
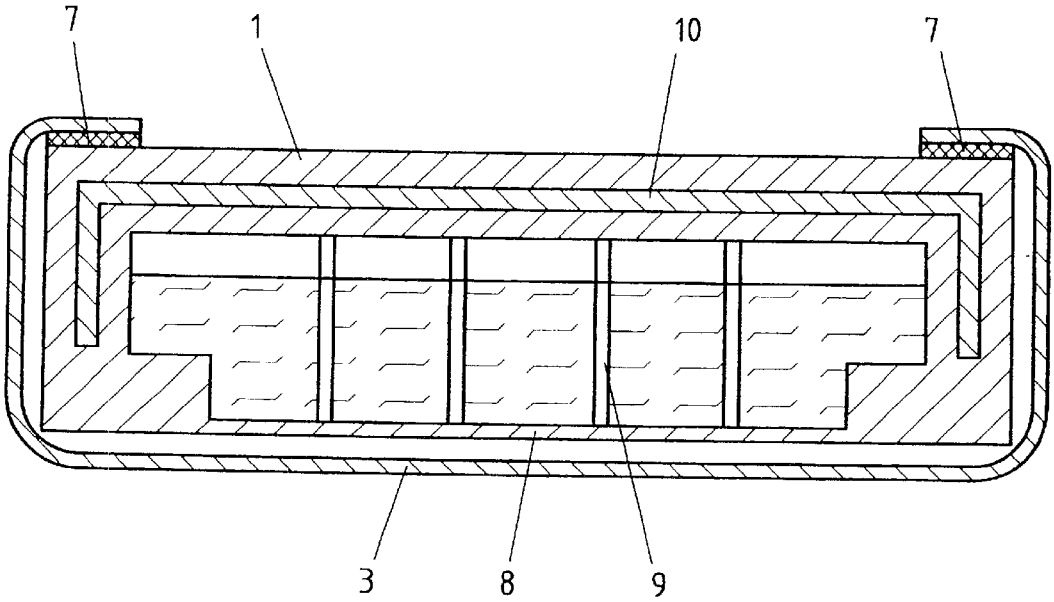
FIG. 3 shows a cross-sectional view of a carrier body, which is structured as a flat rectangular block.

It is advantageous if the side of the block-shaped tank that faces the surface to be cleaned is structured as a heat conduction zone 8. This is shown schematically in a cross-sectional view in FIG. 3. Heat conduction zone 8 is formed in that the wall of the tank is made with a thin wall in the direction towards the wiping surface. Reinforcement ribs 9 ensure that a uniform pressing force can be exerted on the entire wiping surface. The wall of the tank is provided with an insulation 10, which allows the stored amount of heat to be utilized efficiently for the cleaning process. Carrier body 1, shown in FIG. 2, can also be produced particularly cost-effectively, as an injection-molded part. However, heat conduction zone 8 can also be structured in a different way, for example by a material with a high heat conductivity number. Because carrier body 1 forms the reservoir for the heated water that is carried along, in FIG. 2, its weight increases the pressing force of the wiping cover against the floor surface to be cleaned. This is particularly advantageous for in-between cleaning of floors, since small amounts of dirt can often be removed with only a few wiping movements, because of the inherent weight of the carrier body.

Figure 4:
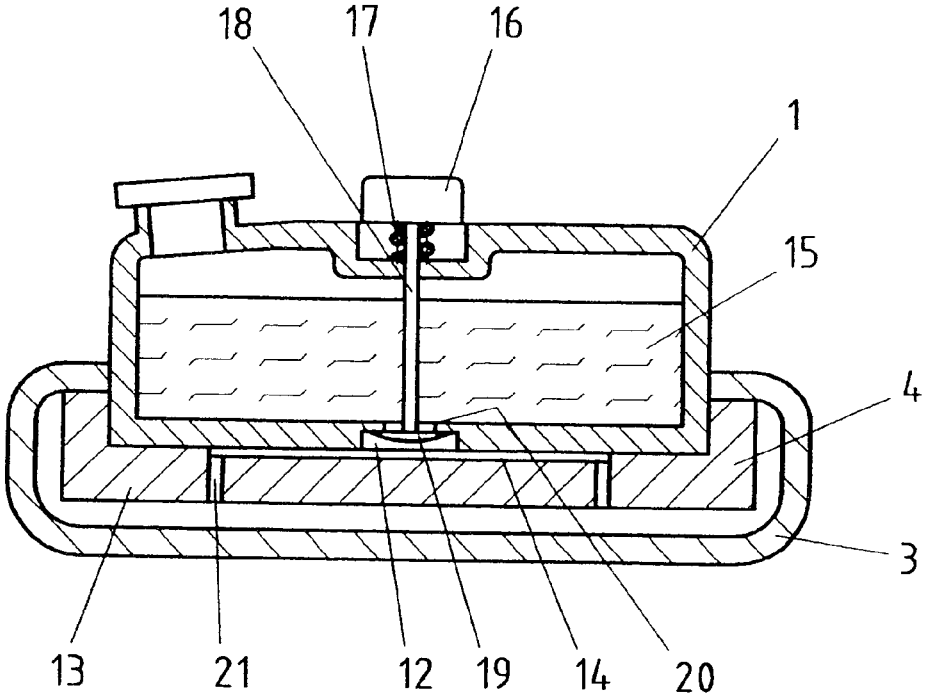
FIG. 4 shows a cross-sectional view through a device, in which the carrier body is structured as a tank for a cleaning fluid.
Figure 5:
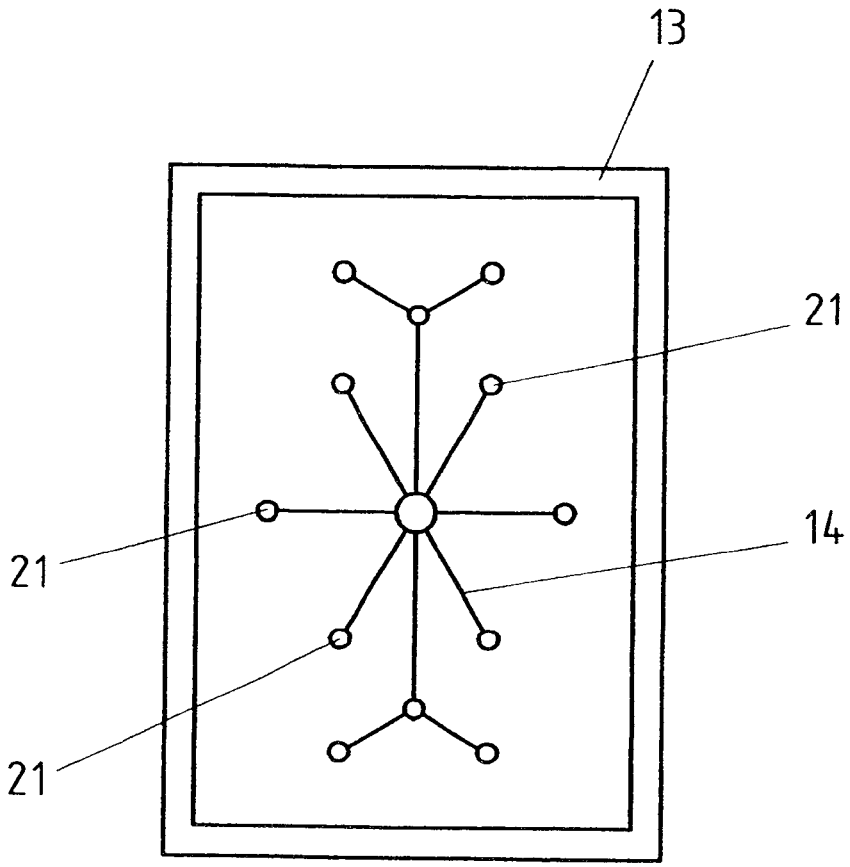
FIG. 5 shows a top view of the water distributor provided on the carrier body according to FIG. 4.

FIG. 4 shows a device for wiping and cleaning dirty surfaces, in which carrier body 1 is structured as a tank for a cleaning fluid 15 and has a rectangular block shape. To fill up used cleaning fluid, the tank is provided with a fill opening that can be closed off with a plug.

In the central region, means 16 are provided, with which opening 12, which is arranged in the central region of the floor surface, can be opened, if necessary, in order to allow cleaning fluid 15 to exit out towards the bottom in this region. These means 16 are made up of a push button 16 that is supported on a pressure spring, and connected with a shaft 18, which has a valve plug 19 at its lower end. In the state of rest, valve plug 19 is pressed against valve seat 20, on the bottom, by the force of pressure spring 17. This causes opening 12 to be closed. If a pressure force is exerted on button 16, valve plug 19 is moved downward, against the force of pressure spring 17, and opening 12 is opened for the duration of activation of button 16. In this way, cleaning fluid 15 can exit down, under the force of gravity.

After exiting from opening 12, cleaning fluid 15 reaches water distributor 13, which is made of elastic, closed-cell foam material and is provided with water distribution channels 14 at its top, and is penetrated by passage openings 21 in the vertical direction. Passage openings 21 are distributed essentially uniformly over the entire surface of water distributor 13. Fluid 15 that exits from opening 12 when button 16 is activated is thereby distributed uniformly over the entire surface of wiping element 3. This can also be formed, if necessary, by a disposable cloth, which is removed from the water distributor after it has become dirty, and replaced by a new cloth. Particularly with regard to cleaning surfaces that are only slightly dirty, such an embodiment has particularly proven itself.

A water distributor of the aforementioned type has good heat insulation properties, because of its closed-cell foam material structure, as it is present, for example, when using closed-cell, foamed, cross-linked polyethylene soft foam, with a density of 30 to 120 kg/m$^3$, preferably at a density of 60 to 90 kg/m$^3$, for its production. In this way, an unnecessary loss of water and heat during the cleaning process is avoided, and nevertheless, an improved cleaning effect is achieved, as a result of the improved heat and water supply to the surface to be cleaned, using supplied cleaning fluid, if necessary. If there is no need for heat and moisture during cleaning, there is the additional possibility of using the structure in the dry state, thereby saving heat and moisture, and of supplying heat and moisture to the surface to be cleaned, by way of the hot water, only if needed. Because of the amount of water and heat that continuously remains on the cleaned surface as the cleaning process progresses, the cleaning cloth continuously dries out, which leads to an ever greater increase in its thermal insulation effect, and thereby to automatic saving of the amount of heat and moisture, which is available only in a limited amount. This is very advantageous, particularly with regard to cleaning large areas that are only slightly dirty.

What is claimed is:

1. A device for wiping and cleaning dirty surfaces, comprising a carrier body for a removable wiping element, wherein the carrier body is designed as a latent heat storage unit and the carrier body has a heat conduction zone designed to transfer heat more readily from the carrier body to a work surface of a removable wiping element than to other areas outside of the carrier body.

2. The device according to claim 1, wherein the heat storage unit has a sensor for a temperature display.

3. The device according to claim 2, wherein the sensor is made of a plastic that contains a thermochrome material.

4. The device according to claim 3, wherein the plastic forms a sheath that encloses the heat storage unit at least proportionally.

5. The device according to claim 4, wherein the sheath is structured as a tank for a cleaning fluid.

6. The device according to claim 5, wherein the wiping element covers a segment of the wall of the tank, which forms a heat conduction zone (8).

7. The device according to claim 6, wherein the wall in the region of the heat conduction zone (8) has a zone with reduced thickness.

8. The device according to claim 6, wherein the zone is reinforced with stiffening ribs (9).

9. The device according to claim 5, wherein the tank has at least one opening (12) through which the cleaning fluid can exit.

10. The device according to claim 9, wherein the opening (12) can be closed, as necessary.

11. The device according to claim 9, further comprising means (16) for metering the amount of cleaning fluid that exits from the opening (12).

12. The device according to claim 11, wherein the means (16) are formed by a pump.

13. The device according to claim 12, wherein the pump has a displacement body that is formed by a piston.

14. The device according to claim 12, wherein the pump has a displacement body that is formed by an elastically deformable part of the wall of the tank.

15. The device according to claim 9, wherein the opening (12) is arranged at the bottom of the tank.

16. The device according to claim 9, wherein a water distributor (13) is arranged between the opening (12) and the wiping element (3).

17. The device according to claim 16, wherein the water distributor (13) is made of an elastic plate.

18. The device according to claim 17, wherein the water distributor (13) is provided with water distribution channels (14).

19. The device according to claim 1, wherein the carrier body is made of a polymer material.

20. The device according to claim 19, wherein the carrier body is shaped to include internal compression reinforcement.

21. The device according to claim 1, wherein the carrier body has a hand hold on an upper side.

22. The device according to claim 21, wherein the hand hold is structured as a shaft and is connected approximately with the center of the top by a cardan joint.

23. The device according to claim 1, wherein the wiping element is a removable wiping cloth made of nonwoven fabric, a loom-knitted or knitted fabric.

24. The device according to claim 23, wherein the wiping element is a disposable wiping cloth and wherein the wiping element is sized not to cover a non-horizontal external surface of the carrier bag.

25. The device according to claim 23, wherein the wiping element is attached to the carrier body by way of a Velcro fastener or insertion pockets.

* * * * *